US009234339B2

(12) United States Patent
Durkin

(10) Patent No.: US 9,234,339 B2
(45) Date of Patent: Jan. 12, 2016

(54) FLUSH TOILET WITH BUILT-IN UNCLOGGING SYSTEM AND RELATED METHODS

(71) Applicant: Shane Durkin, La Jolla, CA (US)

(72) Inventor: Shane Durkin, La Jolla, CA (US)

( * ) Notice: Subject to any disclaimer, the term of this patent is extended or adjusted under 35 U.S.C. 154(b) by 301 days.

(21) Appl. No.: 13/944,781

(22) Filed: Jul. 17, 2013

(65) Prior Publication Data

US 2015/0020297 A1 Jan. 22, 2015

(51) Int. Cl.

| | |
|---|---|
| ***E03C 1/308*** | (2006.01) |
| ***E03D 11/00*** | (2006.01) |
| ***E03F 9/00*** | (2006.01) |

(52) U.S. Cl.

CPC ..... *E03C 1/308* (2013.01); *E03D 11/00* (2013.01); *E03F 9/00* (2013.01)

(58) Field of Classification Search

CPC ..... E03C 1/30; E03C 1/304; E03C 1/308; E03D 9/00; E03D 11/00; E03F 9/00

USPC ..... 4/255.01–255.04, 255.06, 426, 427

See application file for complete search history.

(56) References Cited

U.S. PATENT DOCUMENTS

| | | | | |
|---|---|---|---|---|
| 1,885,977 | A * | 11/1932 | Denison | 137/240 |
| 1,924,498 | A * | 8/1933 | House | 137/240 |
| 1,938,064 | A * | 12/1933 | Carmine | 137/112 |
| 4,115,883 | A * | 9/1978 | Dauvergne | 4/353 |
| 4,538,307 | A * | 9/1985 | Barnum et al. | 4/427 |
| 4,745,641 | A | 5/1988 | Tash | |
| 4,819,279 | A | 4/1989 | Sigler et al. | |
| 4,847,923 | A | 7/1989 | Huang | |
| 5,852,834 | A | 12/1998 | Harvey | |
| 5,862,534 | A | 1/1999 | Clay | |
| 5,963,994 | A | 10/1999 | Harvey | |
| 6,067,668 | A | 5/2000 | Rudd | |
| 6,205,594 | B1 | 3/2001 | Solaberry | |
| 6,643,854 | B1 | 11/2003 | Jensen | |
| 6,668,389 | B1 | 12/2003 | Steinmetz et al. | |
| 8,104,102 | B2 | 1/2012 | O'Hanley | |
| 8,756,721 | B1 * | 6/2014 | Dewey | 4/361 |
| 2008/0244819 | A1 | 10/2008 | Meador | |
| 2009/0211008 | A1 | 8/2009 | Fucito | |

* cited by examiner

*Primary Examiner* — J. Casimer Jacyna
(74) *Attorney, Agent, or Firm* — Buche & Associates, P.C.; John K. Buche

(57) ABSTRACT

In general, a flush toilet with a built-in clog removal system is described. In one embodiment, the disclosed toilet is defined by: a bowl connected to an drain pipe; at least one one-way valve positioned pipe; and a pump in fluid communication with the pipe so that (a) initiating the pump to force the piston downward or upward causes fluid-flow in the pipe so that the one-way valve closes or opens as a result of pressure or a vacuum against debris clogging the drain.

6 Claims, 9 Drawing Sheets

FLUSH TOILET WITH BUILT-IN UNCLOGGING SYSTEM AND RELATED METHODS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

This invention is in the field of flush toilets.

2. Background of the Invention

Toilets are sanitation fixtures used for the disposal of waste, including human excrement and urine. Flush toilets are a common type of toilet that are defined by a bowl that is connected to a hollow and upside-down "U" shaped drain pipe plus a reservoir of water for rapidly filling the bowl. Flushing is accomplished by causing a rapid influx of water from the reservoir into the bowl so that a siphon of water and waste is created through the drain.

Occasionally, drains become clogged. Modern flush toilets are particularly susceptible to clogging because the same are designed to use less water per flush (toilets that use less water are dubbed "eco-friendly"). Various apparatus and methodologies are known for unclogging toilets. One popular apparatus is a plunger, which consists of a rubber cup at the end of a shaft. In operation, the cup may be pushed over the mouth of the clogged drain until the cup is flattened so that, when pulled out, a vacuum is created within the drain to disrupt the clog.

Although useful for unclogging drains, plungers have a few unsatisfactory aspects. For instance, plungers are unsanitary because they frequently contact waste (e.g., fecal matter or urine). Also, plunging can cause splashing of the waste outside of the toilet bowl or on the user. Furthermore, plungers are not always available for unclogging a toilet and their acquisition can be compromising or embarrassing. Accordingly, there is a need for improved apparatus and related methodologies for unclogging a toilet drain without the unsatisfactory aspects of plungers.

SUMMARY OF THE INVENTION

Accordingly, it is an object of the present invention to provide a flush toilet with a built-in unclogging mechanism. In one embodiment, the disclosed toilet is defined by: a bowl connected to an upside-down "U" shaped drain; two one-way valves in series positioned in a downward portion of the "U" shaped pipe; and a piston pump in fluid communication with the downward portion of the U shaped pipe so that (a) initiating the pump to force the piston downward or upward causes fluid-flow in the downward section of the pipe between the one-way valves so that one of the two one-way valves closes and the other of the two one-way valves opens. In operation, moving fluid (air or liquid) through the downward portion of the drain pipe, and the opening and closing of either of the one-way valves will result in pressure or a vacuum against debris clogging the drain.

BRIEF DESCRIPTION OF THE FIGURES

Other objectives of the invention will become apparent to those skilled in the art once the invention has been shown and described. The manner in which these objectives can be achieved is explained in the following description and attached figures in which.

It is to be noted, however, that the appended figures illustrate only typical embodiments of the disclosed apparatus and are therefore not to be considered limiting of its scope, for the invention may admit to other equally effective embodiments that will be appreciated by those reasonably skilled in the relevant arts. Also, figures are not necessarily made to scale.

DETAILED DESCRIPTION OF PREFERRED EMBODIMENTS

In general, a flush toilet with a built-in clog removal system is disclosed. In one embodiment, the disclosed toilet is defined by: a bowl connected to a drain pipe; at least one, one-way valve positioned in a pipe; and a pump in fluid communication with the pipe so that (a) initiating the pump to force the piston downward or upward causes fluid-flow (air or liquid) in the pipe so that the one-way valve closes or opens as a result of pressure or a vacuum against debris clogging the drain. The more specific aspects of the invention are disclosed with reference to the figures.

Figure 1:
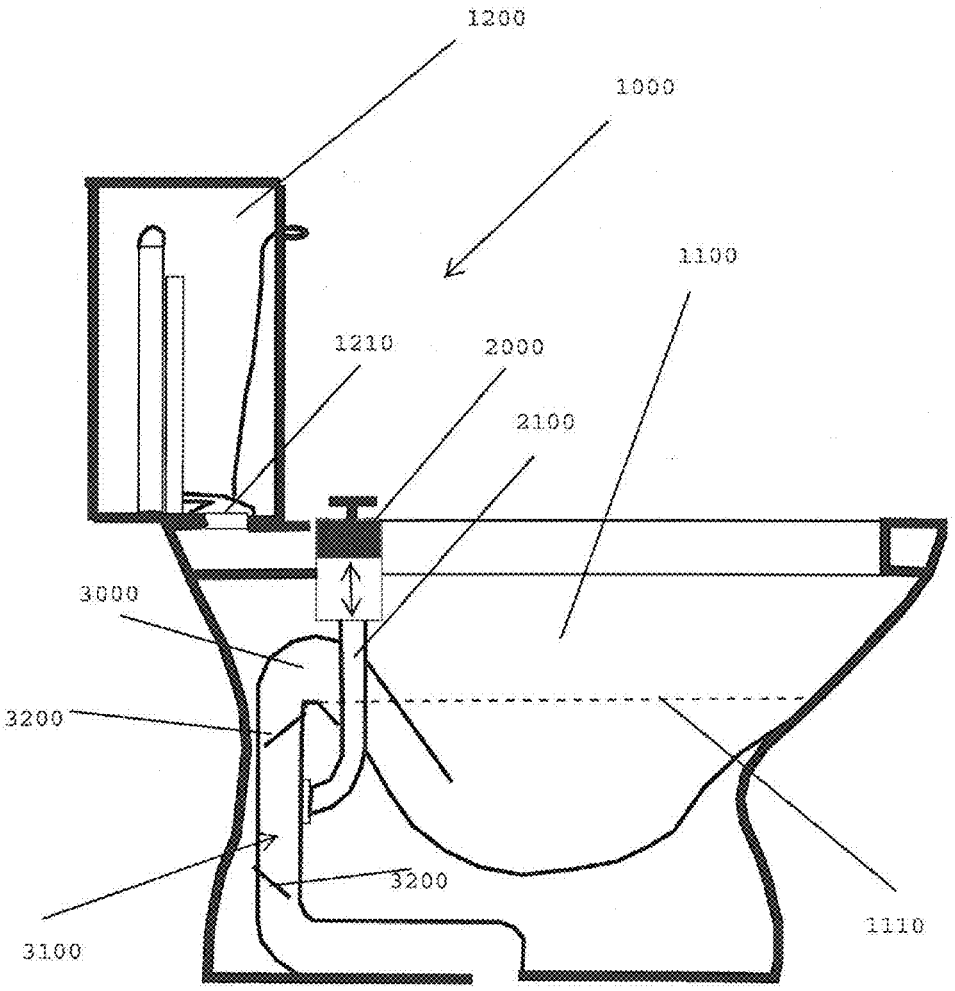
FIG. 1 cross-section of an embodiment of a flush toilet 1000 with built-in unclogging system.
Figure 2:
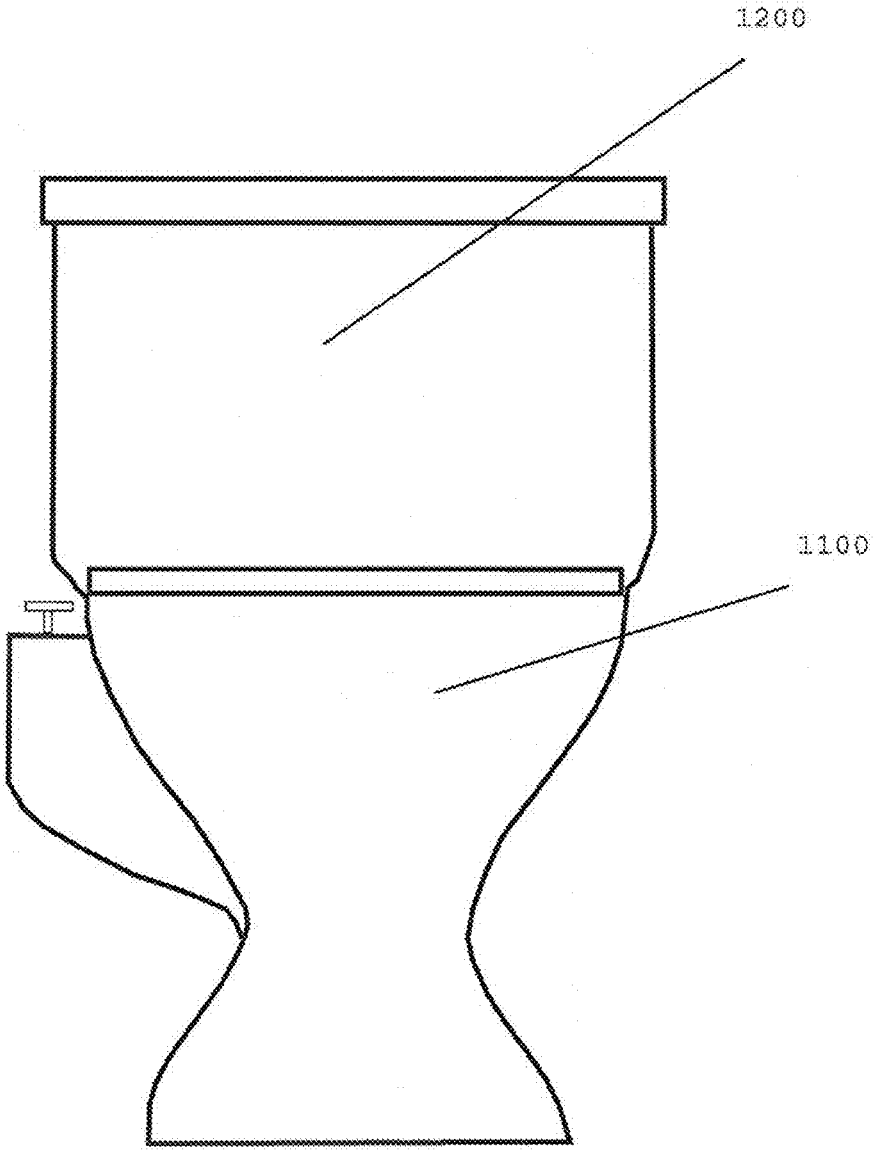
FIG. 2 is a front view of the toilet 1000 of FIG. 1.
Figure 3:
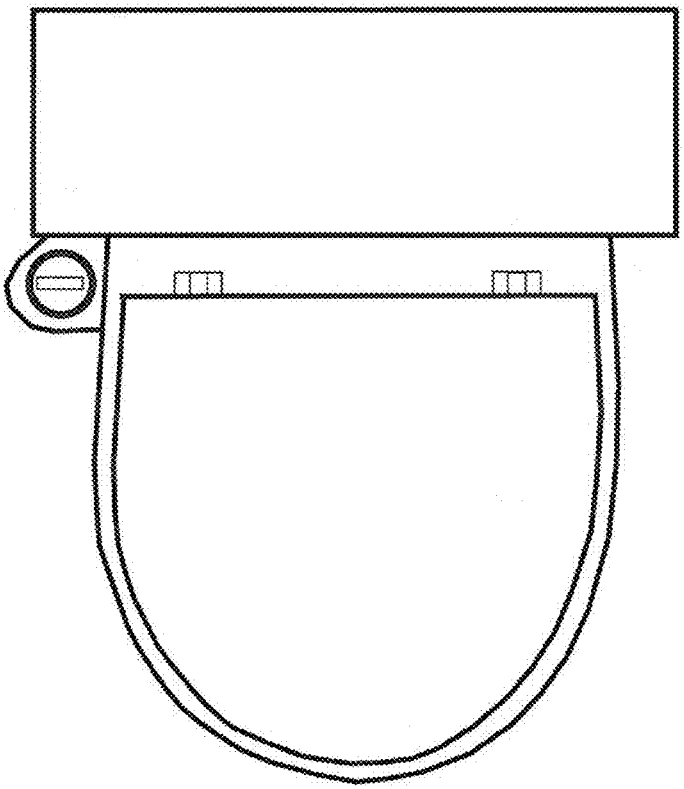
FIG. 3 is a top view of the toilet 1000 of FIG. 1.

FIG. 1 is a cross section of a flush toilet 1000 with a built-in clog removal system. FIGS. 2 and 3 are front and top views of the toilet 1000 shown in FIG. 1. Referring to FIGS. 1 through 3 the toilet 1000 is defined by a bowl 1100 that is coupled to a water tank 1200 and in fluid communication with a hollow and upside-down "U" shaped drain pipe 3000. As shown in FIG. 1, the water tank 1200 is vertically superior to the bowl and features an opening with a stopper 1210 wherein unstopping the opening causes water within the water tank 1200 to rapidly flow into the bowl 1100. Suitably, the bowl 1100 initially features a water level 1110 that does not empty through the drain 3000. Preferably, any rapid influx of water from the water reservoir 1200 into the bowl 1100 may increase the water level 1110 to result in a siphon through the U shaped drain 3000.

Still referring to FIG. 1, the toilet further comprises a pump 2000 that is in fluid communication with a downward portion 3100 of the U-shaped drain pipe 3000. In operation the pump may be used to cause fluid-flow (air or liquid) inside the downward portion 3100 of the drain pipe. In a preferred embodiment, the pump 2000 is a piston pump, which is provided to an air pipe 2100 that is coupled to the downward portion 3100 of the drain 3000. In said embodiment, a screen may be provided to the coupling of the air pipe with the drain so that debris may be prevented from entering the air pipe. It is contemplated, however, that any type of pump may be employed without departing from the spirit and intent of this disclosure.

Figure 5:
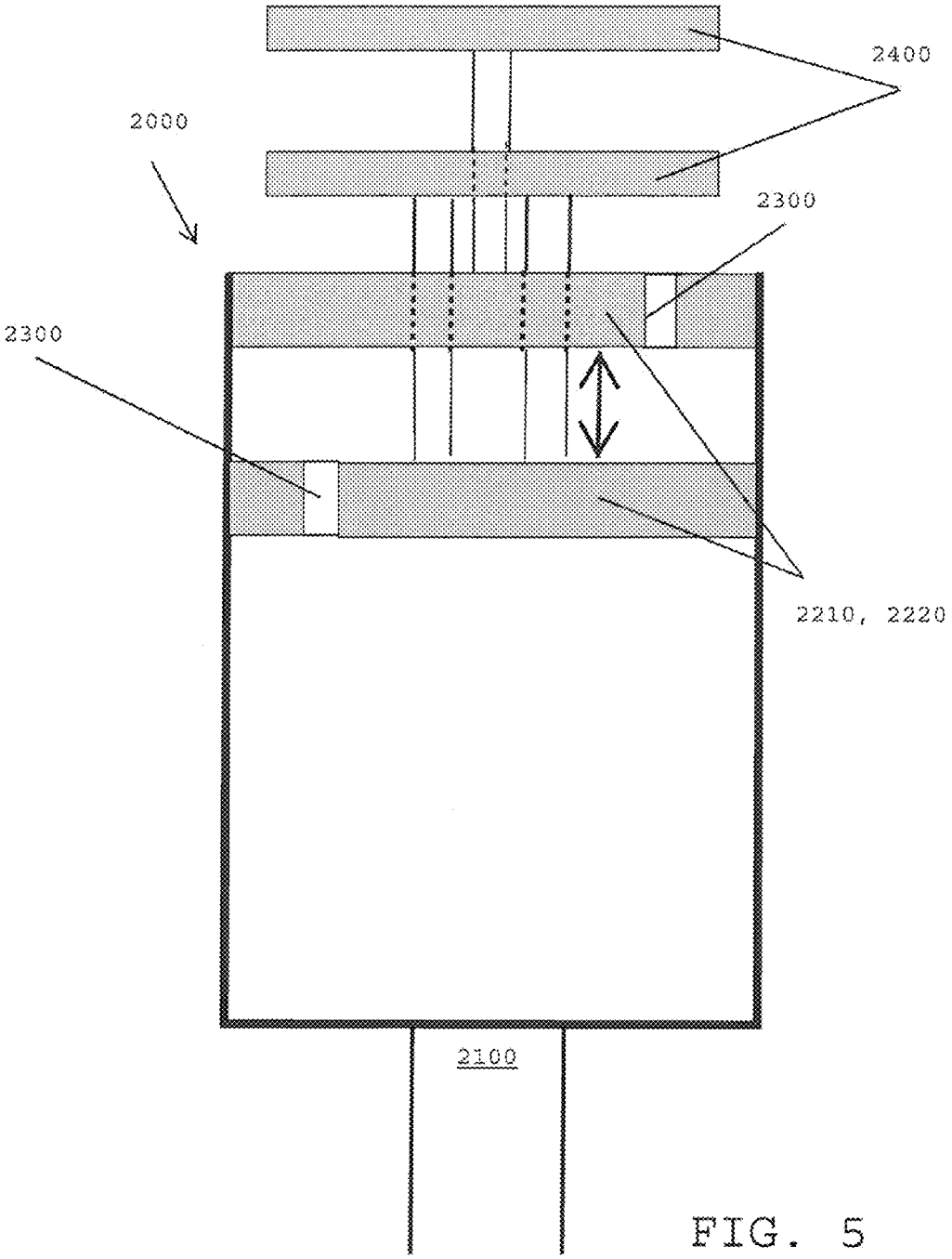
FIG. 5 is a cross-section of a piston pump for operating the disclosed toilet.

FIG. 5 is a cross section of the pump 2000. As shown, the pump may be a piston pump for causing air flow (whether by force or suction) inside the downward portion 3100 (shown in FIG. 1) of the drain 2000. From time-to-time operations of the pump may not be necessary and, as a result, the pump may be deactivated. In the disclosed embodiment, the pump 2000 comprises a piston 2200 that is suitably divided into upper and lower portions 2210, 2220. Suitably the upper and lower portions are movable relative to one another via respective upper and lower handles 2400 that are mechanically interconnected respectively therewith. As shown, the upper and lower portions respectively feature air-inlets 2300 that are closed by interfacing the upper and lower portions 2210, 2220. With the air inlets closed, the pump may be operated in the known manner to produce air-flow within the drain pipe.

Referring back to FIG. 1, the toilet 1000 comprises an upside-down "U" shaped drain pipe 3000 with a downward portion 3100. The pipe 3000 preferably features two one-way valves 3200, or at least one one-way valve 3200. As shown, the pipe 3000 features two one-way valves in the downward portion 3100 of the pipe 3000. Suitably, the valves operate to open or close the drain pipe 3000. As discussed in greater detail below, the valves operate in response to fluid-flows (preferably air but may also be a liquid) generated via the pump 2000.

Figure 4:
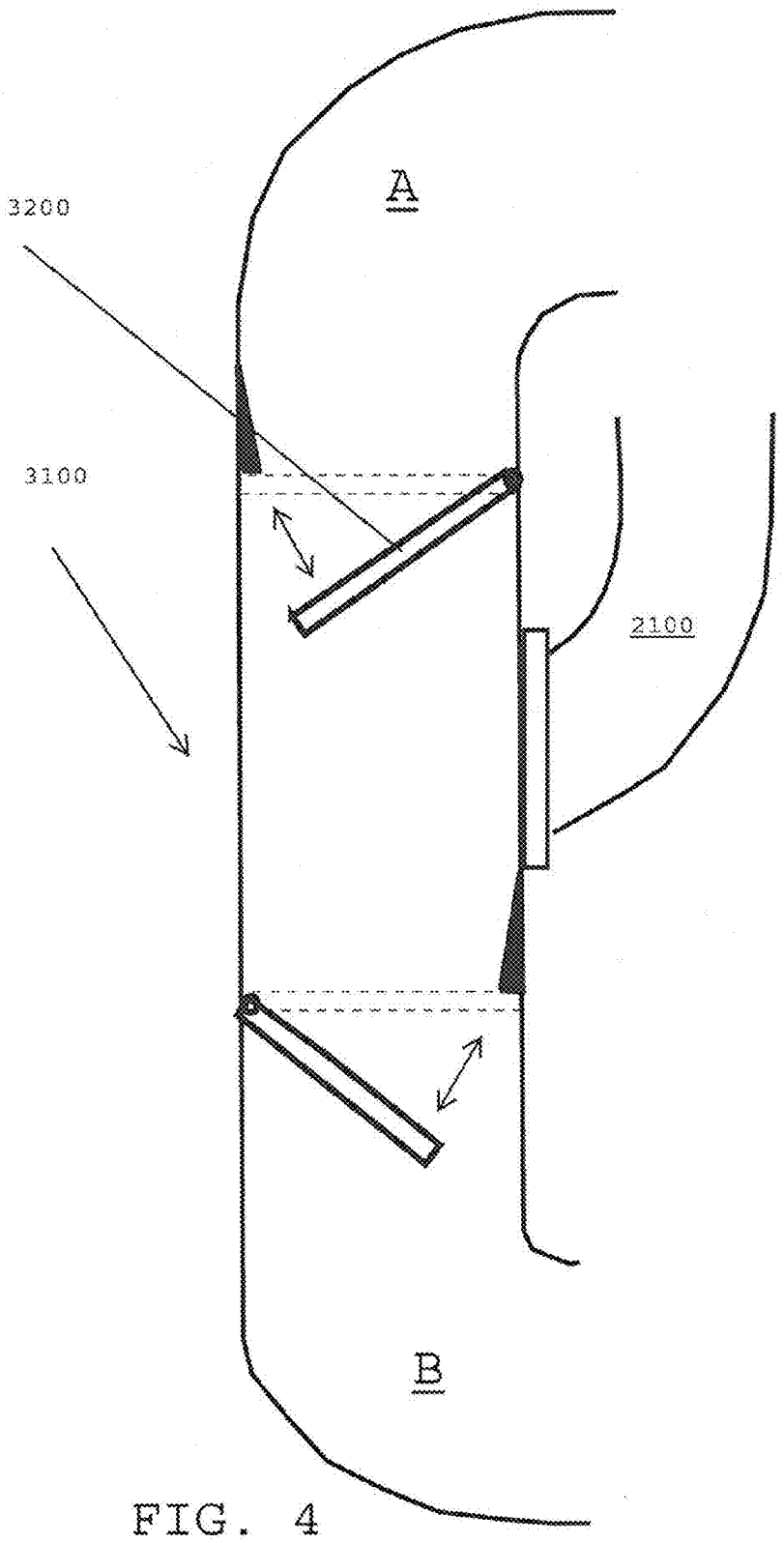
FIG. 4 cross section of a downward portion of a drain pipe.

FIG. 4 is a cross section of the downward portion 3100 of the drain pipe 3000. As shown, the drain features two one way valves, one at a level that is vertically superior to the coupling of the drain 3000 to the air-pipe 2100 of the pump, and one at a level that is vertically inferior to said coupling. When so configured, air flow from the pump 2000 through the air pipe 2100 to within the drain 3000 may close the vertically superior valve and, as a result, apply pressure to a clog occurring within the drain down system of the air pipe. When so configured, fluid flow to the pump 2000 from within the drain may close (illustrated in broken lines in FIG. 4) the vertically inferior valve and, as a result, apply vacuum suction to a clog occurring within the drain up system of the air pipe. In otherwords, sending air through the air pipe 2100 closes one of the valves and, as a result, charges the pump to create pipe-flow by pressure or vacuum suction.

In use, the toilet 1000 generally flushes in the manner known to those skilled in the art of flush toilets. Occasionally, the drain 3000 of the toilet 1000 may become clogged and the pump 2000 may be used to unclog the drain 3000. In a preferred mode of pump operation, a user, referring to FIG. 5, may raise the lower portion 2210 of the piston 2200 relative to the upper portion 2220 of the piston 2200 so that an interface therebetween is established for closing the air-intake holes 2300. After the Air-intake holes 2300 are closed, the pump handle 2400 may be manipulated to drive air into the drain or draw air from the drain 3000 via the air pipe 2100. Referring now to FIG. 4, air flow from the pump 2000 to within the drain may close a vertically superior valve 3200 and, as a result, apply pressure to a clog occurring within the drain 3000 down system of the air pipe 2100 while air flow to the pump from within the drain 3000 may close a vertically inferior valve 3200 and, as a result, apply vacuum suction to a clog occurring within the drain 3000 up system of the air pipe 2100. Suitably, clogs may be removed from the drain by repeatedly causing pressurizing or vaccumizing air flow in the drain 3000 via operation of the pump 2000. In other words, a clog may be pushed or pulled through the pipe to end the clog.

Exemplary Usage 1.

Referring to FIG. 4, a user may experience a clog at point A. To remove the clog, a user may first activate the pump 2000 by, as discussed in connection with FIG. 5, creating an interface between the upper and lower portions 2210, 2220 of the piston 2200 so that the air intake holes 2300 are closed. After the air holes 2300 are closed, the pump handle 2400 may be manipulated to draw air from the drain 3000 (not shown in FIG. 5) via the air pipe 2100. Referring to FIG. 4, air flow from the drain 3000 to within the pump 2000 (not shown in FIG. 4) via the air pipe 2100 may close the lower valve 3200 and, as a result, apply vacuum suction to the clog A. Suitably, the clogs may be removed from the drain by repeatedly causing vaccumizing air flow in the drain via operation of the pump.

Exemplary Usage 2.

Referring to FIG. 4, a user may experience a clog at point B. To remove the clog B, a user may first activate the pump 2000 by, as discussed in connection with FIG. 5, creating an interface between the upper and lower portions 2210, 2220 of the piston 2200 so that the air intake holes 2300 are closed. After the air holes 2300 are closed, the pump handle 2400 may be manipulated to force air into the drain 3000 (not shown in FIG. 5) via the air pipe 2100. Referring to FIG. 4, air flow from the pump 2000 (not shown in FIG. 4) to within the drain 3000 via the air pipe 2100 may close the upper valve 3200 and, as a result, apply pressure to the clog B. Suitably, the clogs may be removed from the drain by repeatedly causing forced air flow in the drain via operation of the pump.

Figure 6:
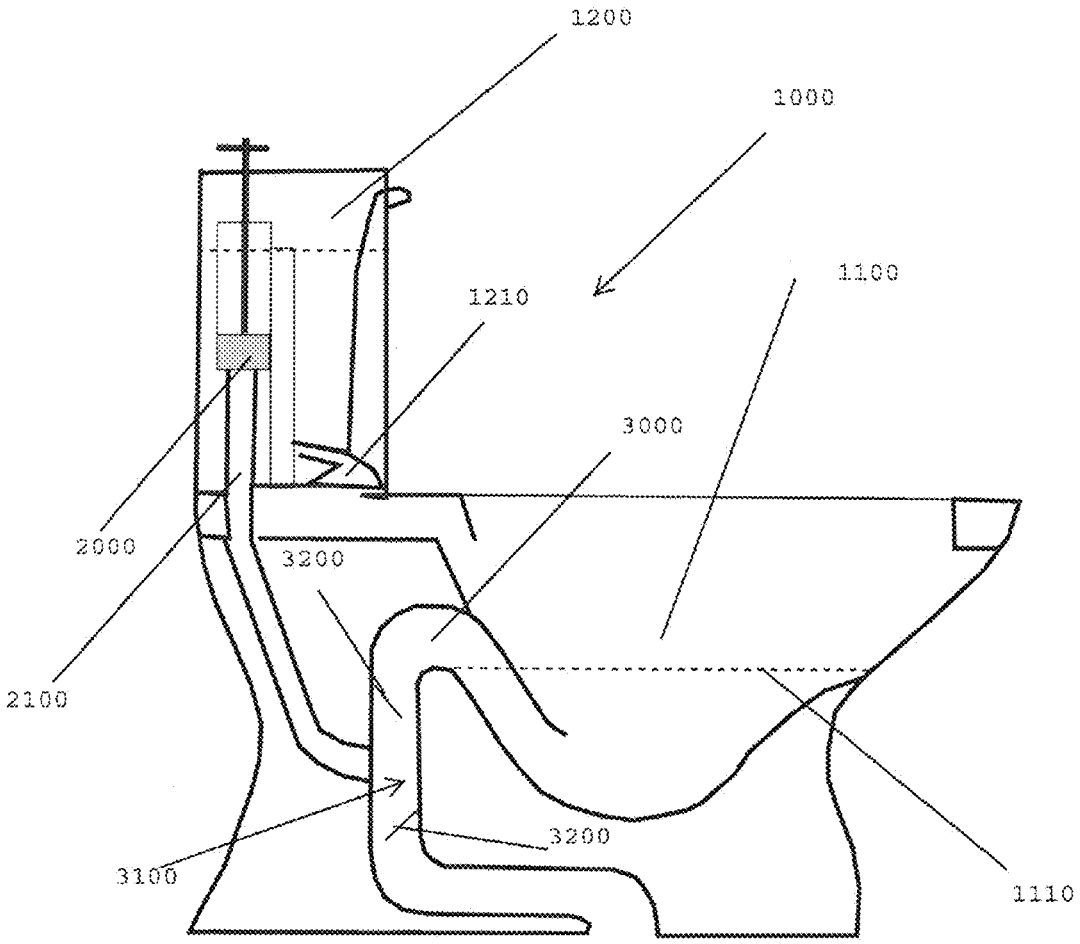
FIG. 6 cross-section of an embodiment of a flush toilet 1000 with built-in unclogging system.
Figure 7:
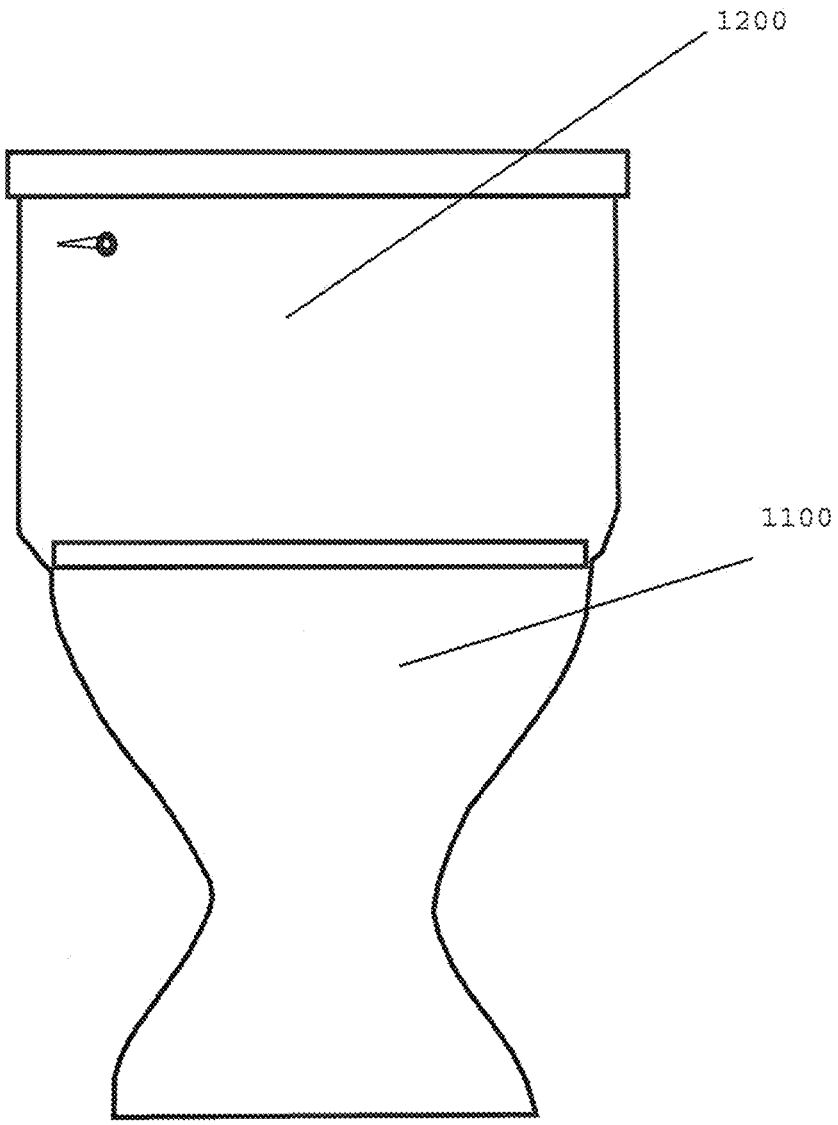
FIG. 7 is a front view of the toilet 1000 of FIG. 6.
Figure 8:
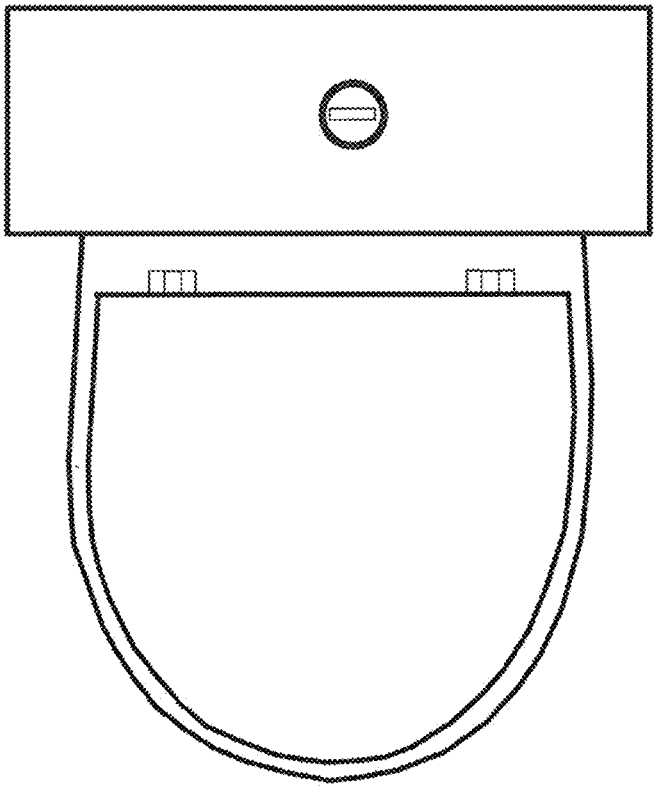
FIG. 8 is a top view of the toilet 1000 of FIG. 6.

FIG. 6 is a cross section of a flush toilet 1000 with a built-in clog removal system. FIGS. 7 and 8 are front and top views of the toilet 1000 shown in FIG. 6. Referring to FIGS. 6 through 8, the toilet 1000 is defined by a bowl 1100 that is coupled to a water tank 1200 and in fluid communication with a hollow and upside-down "U" shaped drain pipe 3000. As shown in FIG. 1, the water tank 1200 is vertically superior to the bowl and features an opening with a stopper 1210 wherein unstopping the opening causes water within the water tank 1200 to rapidly flow into the bowl 1100. Suitably, the bowl 1100 initially features a water level 1110 that does not empty through the drain 3000. Preferably, any rapid influx of water from the water reservoir 1200 into the bowl 1100 may increase the water level 1110 to result in a siphon through the U shaped drain 3000.

Still referring to FIG. 1, the toilet further comprises a pump 2000 that is in fluid communication with a downward portion 3100 of the U-shaped drain pipe 3000. In operation the pump may be used to cause fluid-flow (air or liquid) inside the downward portion 3100 of the drain pipe. In a preferred embodiment, the pump 2000 is a piston pump, which is provided to an air pipe 2100 that is coupled to the downward portion 3100 of the drain 3000. In said embodiment, a screen may be provided to the coupling of the air pipe with the drain so that debris may be prevented from entering the air pipe. It is contemplated, however, that any type of pump may be employed without departing from the spirit and intent of this disclosure.

As shown, the pump may be a piston pump for causing air flow (whether by force or suction) inside the downward portion 3100 (shown in FIG. 6) of the drain 2000. From time-to-time operations of the pump may not be necessary and, as a result, the pump may be stored in the downward, or compressed position during normal toilet use and operation.

Referring back to FIG. 6, the toilet 1000 comprises an upside-down "U" shaped drain pipe 3000 with a downward portion 3100. The pipe 3000 preferably features two or at least one one-way valve 3200. As shown, the pipe 3000 features two one-way valves in the downward portion 3100 of the pipe 3000. Suitably, the valves operate to open or close the drain pipe 3000. As discussed in greater detail below, the valves operate in response to fluid-flows (preferably air but may also be a liquid) generated via the pump 2000.

Figure 9:
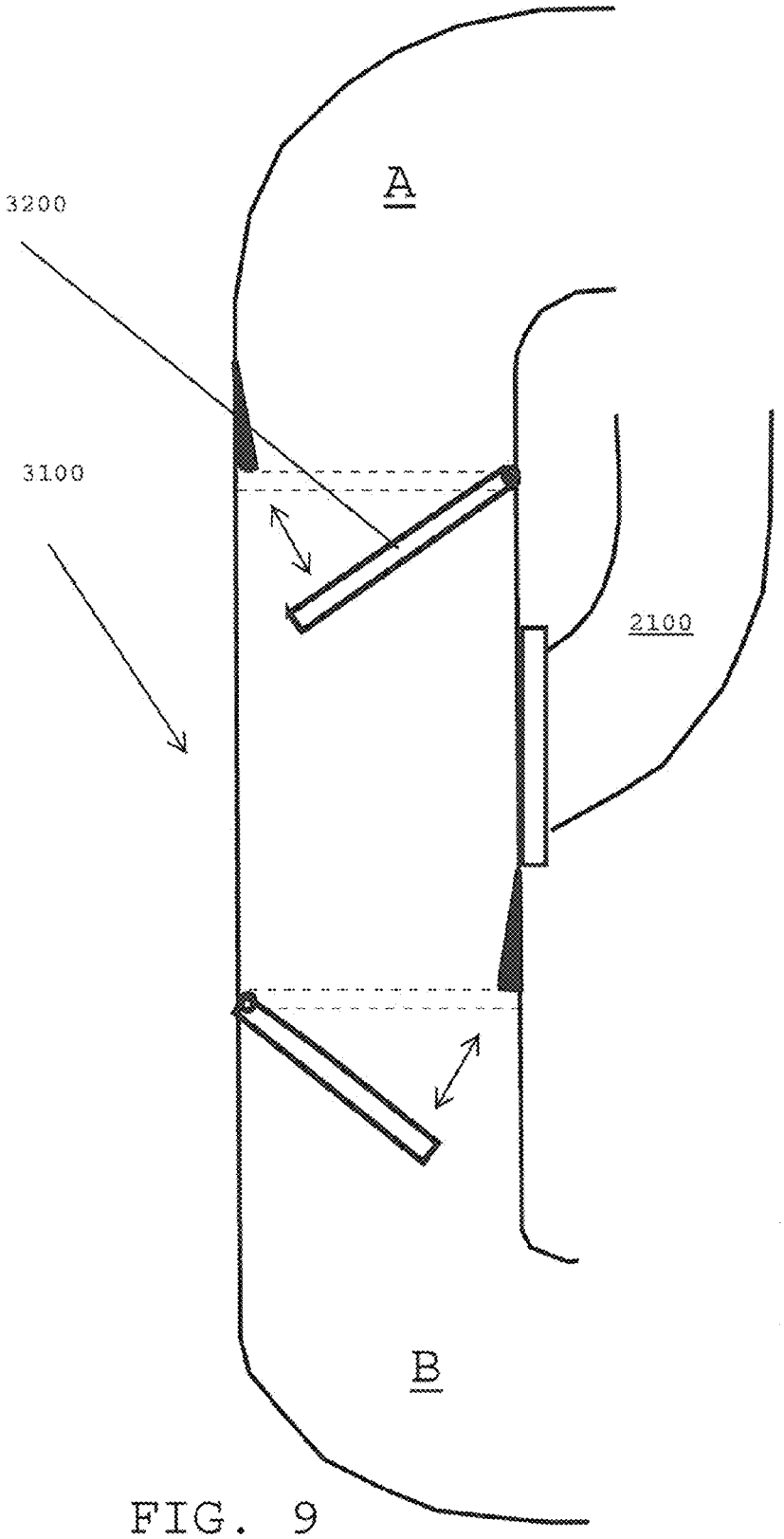
FIG. 9 cross section of a downward portion of a drain pipe.

FIG. 9 is a cross section of the downward portion 3100 of the drain pipe 3000. As shown, the drain features two one way valves, one at a level that is vertically superior to the coupling of the drain 3000 to the air-pipe 2100 of the pump, and one at a level that is vertically inferior to said coupling. When so configured, air flow from the pump 2000 through the air pipe to within the drain 3000 may close the vertically superior valve and, as a result, apply pressure to a clog occurring within the drain down system of the air pipe 2100. When so configured, fluid flow to the pump 2000 through the air pipe 2100 from within the drain may close (illustrated in broken lines in FIG. 9) the vertically inferior valve and, as a result, apply vacuum suction to a clog occurring within the drain up system of the air pipe.

In use, the toilet 1000 generally flushes in the manner known to those skilled in the art of flush toilets. Occasionally, the drain 3000 of the toilet 1000 may become clogged and the pump 2000 may be used to unclog the drain 3000. In a preferred mode of pump operation, the pump handle 2400 may be manipulated to drive air into the drain or draw air from the drain 3000 via the air pipe 2100. Suitably, clogs may be removed from the drain by repeatedly causing pressurizing or vaccumizing air flow in the drain 3000 via operation of the pump 2000. In other words, a clog may be pushed or pulled through the pipe to end the clog.

Exemplary Usage 1.

Referring to FIG. 9, a user may experience a clog at point A. To remove the clog, a user may use the pump handle 2400 to draw air from the drain 3000 via the air pipe 2100. Referring to FIG. 9, air flow from the drain 3000 (not shown in FIG. 9) to within the pump 2000 via the air pipe 2100 may close the lower valve 3200 and, as a result, apply vacuum suction to the clog A. Suitably, the clogs may be removed from the drain by repeatedly causing vaccumizing air flow in the drain via operation of the pump.

Exemplary Usage 2.

Referring to FIG. 4, a user may experience a clog at point B. To remove the clog B, a user may use the pump handle 2400 to force air into the drain 3000 via the air pipe 2100. Referring to FIG. 9, air flow from the pump 2000 to within the drain 3000 (not shown in FIG. 9 via the air pipe 2100 may close the upper valve 3200 and, as a result, apply pressure to the clog B. Suitably, the clogs may be removed from the drain by repeatedly causing forced air flow in the drain via operation of the pump.

It should be noted that those of skill in the art may appreciate alternate embodiments of the invention after reading this disclosure. This description of a preferred embodiment is not intended to be a limit to the scope of this disclosure. On the contrary, applicant contemplates many alternative embodiments that may be contrived and used without departing from the spirit and intent of this written description.

I claim:

1. A flush toilet with a built-in clog removal system comprising:

a bowl that is coupled to a water source and in fluid communication with a hollow and upside-down U shaped drain pipe;

wherein the water source is vertically superior to the bowl so that causing water to rapidly flow into the bowl results in a siphon through the upside-down U shaped drain pipe;

a pump with an air-pipe that is coupled to a downward portion of the upside-down U-shaped drain pipe;

said pump configured to cause fluid-flow through said air-pipe to inside the downward portion of the upside-down U-shaped drain pipe;

said coupling of the air-pipe and the U-shaped drain pipe located between two one way valves in the downward portion of the upside-down U-shaped drain pipe;

wherein one of said valves is configured to open in response to fluid-flow from the pump through the air-pipe to within the downward portion of the upside-down U-shaped drain pipe; and, wherein the other one of said valves is configured to close in response to fluid-flow from the pump through the air-pipe to within the downward portion of the upside-down U-shaped drain pipe.

2. The toilet of claim 1 wherein pressure is applied to a clog occurring within the drain via closing one of said valves during fluid-flow from said pump.

3. The toilet of claim 1 wherein vacuum suction is applied to a clog occurring within the drain.

4. The toilet of claim 1 wherein the fluid flow is air-flow.

5. The flush toilet of claim 1 wherein said pump is a piston pump.

6. The flush toilet of claim 1 wherein a screen exists across said coupling of the air-pipe and the upside-down u-shaped drain pipe.

* * * * *